US006038976A

United States Patent [19]

Helmstädter et al.

[11] Patent Number: 6,038,976

[45] Date of Patent: Mar. 21, 2000

[54] SUCTION-AIR CONTROL DEVICE

[75] Inventors: Karl-Heinz Helmstädter, Sinsheim; Raimund Schröder, Hockenheim, both of Germany

[73] Assignee: Heidelberger Druckmaschinen AG, Heidelberg, Germany

[21] Appl. No.: 09/220,326

[22] Filed: Dec. 24, 1998

[30] Foreign Application Priority Data

Dec. 24, 1997 [DE] Germany ..... 197 57 925

[51] Int. Cl.[7] ..... B41F 1/30; B41F 21/10; B41F 21/00; B41F 13/24; B41F 5/16

[52] U.S. Cl. ..... 101/410; 101/232; 101/246; 101/174; 271/276; 271/902

[58] Field of Search ..... 101/171, 174, 101/177, 216, 217, 246, 248, 408, 407.1, 229–233, 409, 410; 271/275–277, 204–206, 82, 902

[56] References Cited

U.S. PATENT DOCUMENTS

| | | | |
|---|---|---|---|
| 4,202,542 | 5/1980 | Lammers et al. | 271/276 |
| 4,277,010 | 7/1981 | Landskroener et al. . | |
| 4,728,092 | 3/1988 | Selak | 271/100 |
| 4,790,244 | 12/1988 | Otfried et al. | 101/231 |
| 4,991,832 | 2/1991 | Spiegel et al. | 271/183 |
| 5,241,907 | 9/1993 | Dörsam et al. . | |
| 5,542,659 | 8/1996 | Haupenthal | 271/108 |
| 5,794,926 | 8/1998 | Hansch | 270/52.26 |
| 5,833,228 | 11/1998 | Nagata et al. | 271/11 |

FOREIGN PATENT DOCUMENTS

| | | |
|---|---|---|
| 2 109 237 | 9/1972 | Germany . |
| 27 54 370 A1 | 6/1979 | Germany . |
| 31 11 894 C2 | 2/1986 | Germany . |
| 41 26 643 A1 | 2/1993 | Germany . |
| 43 32 491 A1 | 3/1995 | Germany . |
| 42 17 851 C2 | 2/1997 | Germany . |

*Primary Examiner*—Kimberly Asher
*Attorney, Agent, or Firm*—Herbert L. Lerner; Laurence A. Greenberg; Werner H. Stemer

[57] ABSTRACT

A suction-air control device for controlling suction air applied to suction openings of a printing-press cylinder, having controllable valves by which the suction openings are connectable to a suction-air source, and a first pneumatic control device for timed or cyclically feeding the suction air, includes a second pneumatic control device for controlling the suction air in a manner dependent upon the format of the printing substrate, the valves being pneumatically controllable and being disposed on the cylinder.

10 Claims, 6 Drawing Sheets

SUCTION-AIR CONTROL DEVICE

BACKGROUND OF THE INVENTION

1. Field of the Invention

The invention relates to a suction-air control device for controlling vacuum applied to suction openings of a printing press cylinder and, in particular, to such a device for opening and shutting off suction-air lines on sheet-transfer drums of sheet-fed rotary offset printing presses having sheet trailing-edge suction grippers.

Control devices of this general type serve for conveying small-format sheets of printing substrate on a variable-format cylinder provided with a group of suction openings constructed for the maximum format, aspiration or sucking-in of faulty air by the suction openings not covered by the smaller-format sheets of printing substrate being avoided. High energy consumption, poor efficiency, in an extreme case breakdown of the vacuum, aspiration or sucking-in of relatively large contaminant particles and increased noise emission during operation of the printing press are thereby avoided.

In the published German Patent Document DE-A-21 09 237, there is described a suction roller of adjustable suction width for sucking sheets or cut-to-size pieces of paper or the like onto it and conveying them, the suction roller having remote-controllable valves which serve for connecting individual groups of suction holes to a suction-air source. The valves are either fitted on control heads and can be operated from a central location or are arranged at a central location and are connected via pipelines to a plurality of control heads, but are in no way fitted on the cylinder. With this device, the suction widths of a plurality of rollers is able to be set within the shortest change-over times from a central location. A disadvantage thereof is that the construction of the disk or ring-shaped, wearing component of the control head becomes more complicated with increasingly finer graduation of the subdivision of the groups of suction holes and as a consequence requires more costly production. The device proposed in the prior art can be well utilized in the case of the cited envelope-making machines with broad graduation of the suction holes into three suction hole groups, but only poorly with printing-press cylinders requiring a finely graduated, greater number of suction holes and suction hole groups, respectively. Emphasis is placed upon solenoid valves as a particularly suitable possibility for controlling the valves. It is unfavorable, in this regard, that in addition to the pneumatic system already present in any event on the press, a second system be installed, the electrical system being prone to failure. Because the solenoid valves are comparatively expensive, their use in large numbers in the case of the printing-press cylinder with fine suction hole graduation, mentioned hereinbefore, is not very advantageous. The valves are not arranged on the suction roller, but rather, externally. The preferred solenoid valves also cannot be arranged well on the rotatable suction roller, because the electrical clutch would be complex. Due to the external valve arrangement, the suction-air channels leading from the valves to the suction openings on the lateral surface of the suction roller which are not covered by printing substrate or the like are exposed to a risk of soiling in the form of penetration or ingress by foreign bodies, for example accumulating particles of paper.

In German Published Non-prosecuted Patent Application (DE-OS) 27 54 370, a stacker roller is described having suction openings provided with automatically acting closing mechanisms which respectively close those suction openings which are not covered by covering material. These valves are pneumatically operated, but are not controllable, and instead closing and opening of their own accord. No pneumatic control device for the exactly timed feeding of the suction air in a manner dependent upon the angle of rotation is provided in this reference. It is unfavorable in this regard that the valves function comparatively unreliably. Reliable functioning is dependent upon the amount of vacuum applied to the suction openings. If printing substrates of different weights, for example thin paper and cardboard, are to be guided on a roller of such a construction, a variation in the intensity of the suction air is often required. A reduced intensity of the suction air may have as a consequence that the self-operated valves respond with delay, or more slowly. Contaminants deposited in the valves, for example lint, may moreover influence the sliding frictional conditions of the guided valve elements in an unpredictable manner. The guidance of printing substrate on a printing-press cylinder requires very exactly timed feeding of the suction air, however, and in particular absolutely reliable functioning of the valves with all types of printing substrate. This is particularly important, for example, if a sheet of printing substrate which is guided on a drum with suction openings holding the sheet is to be transferred to a downline drum, it being not always possible for the sheet to be simply drawn off from the sucking suction openings. As a result of valves not opening, or not opening at the correct time, it is possible, for example in the region of a corner of a sheet of printing substrate, for fluttering or creasing of the unsecured corner to occur. What is more, these effects may be misinterpreted by sensors on the printing press. A bent-over corner may be interpreted, for example, as a double sheet, as a consequence of which the sensor causes the press to stop when it may not be necessary. Regular cleaning, for example blowing out, of the valve seats after comparatively short servicing intervals would increase the downtime of the press and only partially remedy the disadvantage mentioned, because the unreliable functioning, as described hereinabove, is not only contamination-dependent but also construction-dependent. Integration of these self-operated valves into conventional rotary suckers would be a complex undertaking from a construction standpoint.

In German Published Non-prosecuted Patent Application (DE-OS) 41 26 643 A1, a drum for transporting and transferring sheets is described, which has shut-off valves for disconnecting the lines not required for paper format reasons. The shut-off valves are arranged on the drum and are not controllable but manually operatable.

SUMMARY OF THE INVENTION

Proceeding from the state of the prior art, it is accordingly an object of the invention to provide a suction-air control device for controlling the suction air that can be applied to suction openings of a cylinder of a printing press which facilitates a fine graduation of the suction openings and ensures reliable guidance of different types of printing substrate.

With the foregoing and other objects in view, there is provided, in accordance with the invention, a suction-air control device for controlling suction air applied to suction openings of a printing-press cylinder, having controllable valves by which the suction openings are connectable to a suction-air source, and a first pneumatic control device for timed or cyclically feeding the suction air, comprising a second pneumatic control device for controlling the suction air in a manner dependent upon the format of the printing substrate, the valves being pneumatically controllable and being disposed on the cylinder.

In accordance with another feature of the invention, the second pneumatic control device serves for controlling the suction air in a manner dependent upon the format width of the printing substrate.

In accordance with a further feature of the invention, each of the valves comprises a pneumatically adjustable actuating element.

In accordance with an added feature of the invention, the valves are controllable by the second pneumatic control device.

In accordance with an additional feature of the invention, the actuating element is pneumatically adjustable by control air controllable by the second pneumatic control device.

In accordance with yet another feature of the invention, the suction air of the suction-air source serves as the control air.

In accordance with yet a further feature of the invention, each of the valves has a housing formed with a cavity, the actuating element being disposed in the cavity and being adjustable into a first position and into a second position, a first line opening into the cavity and forming an inlet opening, and a second line opening into the cavity and forming an outlet opening, the actuating element, in a first position thereof, being effective for releasing an airflow from the inlet opening to the outlet opening that is different in magnitude from that of an airflow releasable in a second position thereof.

In accordance with yet an added feature of the invention, the valves are connected to the second pneumatic control device in an air-conducting manner, and the second pneumatic control device is connected via a connection line to the first pneumatic control device and is connected to the suction-air source in an air-conducting manner.

In accordance with yet an additional feature of the invention, the device includes a nonreturn valve disposed in the connection line.

In accordance with still another feature of the invention, the second pneumatic control device comprises first and second control elements which are adjustable with respect to one another, the first control element being formed with a recess, control lines opening into the second control element and forming aperture openings, the recess formed in the first control element being assignable to various ones of the aperture openings in dependence upon adjustment of the first and the second control elements.

In accordance with still a further feature of the invention, the cylinder is a sheet-transfer drum of a reversing device of the printing press, and the printing press is in a first-form and perfector printing mode.

In accordance with still an added feature of the invention, the suction openings are formed as rotary suckers for seizing a trailing edge of a sheet of printing substrate and pulling it taut.

In accordance with a concomitant feature of the invention, the device is in combination with a printing press wherein it is installed.

The device according to the invention for controlling the suction air which can be applied to suction openings of a cylinder of a printing press, having remote-controllable valves by which the suction openings can be connected to a suction-air source, and having a first pneumatic control device for the timed feeding of the suction air, comprises a second pneumatic control device for controlling the suction air in a way dependent upon the format of the printing substrate, and comprises the feature of the valves being arranged on the cylinder and being pneumatically controllable. This device ensures reliable guidance of the printing substrate even under aggravated operating conditions. A fine graduation of the suction openings is possible in a comparatively noncomplex manner.

Hereinafter, a cylinder is understood to mean a rotary element by which the printing substrate in web or sheet form is guided and/or conveyed. The rotary element may be formed as a drum with a substantially closed and cylindrical outer contour on which the sheet of printing substrate rests, held by the suction openings. The cross section of the cylinder, as viewed in the direction of the axis of rotation, may be substantially circular or substantially polygonal, for example rhombic. The lateral surface of the cylinder may be composed of elements which can be adjusted in the position thereof with respect to one another. In addition to the action of the suction openings, the printing substrate which is guided and/or conveyed by the cylinder may be held by a further holding member with the same or a different action, arranged on the cylinder, for example holding fingers or pincers and pins. Furthermore, the suction openings may be supplied with blowing air instead of or in addition to being subjected to suction air, or alternatively. The suction openings may be arranged in one or more rows on the circumferential surface of the cylinder, it being possible for the row or rows to extend in the circumferential direction of the cylinder, or in the transporting direction of the printing substrate, and parallel to the axis of rotation of the cylinder, or in a transverse direction. An arrangement of suction openings, in particular a row of suction openings extending in the direction of the cylinder axis, may be varied or set according to choice, in dependence upon the format width of the printing substrate which is to be processed. An arrangement of suction openings, in particular a row of suction openings extending in the circumferential direction, may be controlled in dependence upon the format length. A row of suction openings may be controlled by the suction openings of the row being switched on or off in a stepped or staggered manner, proceeding from one or both ends of the row, which may be from the left-hand and/or right-hand end or from the front and/or rear end, and continuing in the direction of the other end of the row, respectively. Rows of suction openings in the transverse direction which are not covered by the leading edge or trailing edge of the sheet of printing substrate and rows of suction openings in the circumferential direction which are not covered by the side edges of the sheet or web of printing substrate can be controlled and deactivated, respectively, row by row by a single valve, to which all the suction openings of the respective row are assigned. In addition to these functional groupings of a plurality of suction openings and assignments to a common valve, it is similarly possible for every second, third and so forth suction opening of a row or of a plurality of suction openings in certain positions of arrangements of suction openings extending over a surface area or in matrix form to form functional groups of which the suction openings can be put into operation and taken out of operation jointly or simultaneously. In this manner, the row or area-related total suction power and holding force of the cylinder can be varied. The suction-air source may be constructed as a compressor and as a central suction-air source of the printing press supplying a plurality of units or cylinders with suction air. In addition to a vacuum or negative-pressure source, a positive-pressure source may also be provided, so that, for example, the openings can be subjected to blowing air and suction air on a different time basis and/or location basis or alternatively. A pneumatic control device is understood in connection with the invention to mean control devices of which the controlled system is a pneumatic system, for example a suction-air system, the air conducted in this system and controlled by the control device representing the controlled correcting variable or manipulatable variable on the output side. The control is operated mechanically, i.e., a manual or automated adjustment of one or more parts of the pneumatic control device performed by actuators takes place. Typical pneumatic control devices are, for example, control distributors, multiway valves or rotary valves. With a rotary valve known per se, such as, for example, the control heads described in German Patent 21 09 237 or the combined sealing-ring/wearing-disk roller element described in the published German Patent Document DE 31 11 894 C2, a timed or cyclic feeding of the suction air can take place. Timed or cyclic feeding is to be understood to mean subjecting certain suction openings to suction air in a manner dependent upon the rotation of the cylinder, or synchronized therewith, i.e., a temporary opening and closing of the air-conducting connection between a suction opening and the suction-air source assigned to the latter which is dependent upon the angle of rotation, or the phase position, of the cylinder. By timed feeding it is possible, for example, for a sheet of printing substrate which has been transferred to the cylinder and is to be received thereby to be secured by the suction openings precisely at the correct point in time and for a sheet of printing substrate which is to be delivered or transferred from the cylinder to be released by the suction openings at the correct point in time. By contrast with the remote control of solenoid valves described in the prior art, it being known that these valves are electrically remote-controlled, the pneumatic valves according to the invention are operatable or controllable by suction air and/or compressed air. Unlike the valves which close of their own accord in the uncovered state, likewise described in the cited prior art, it is possible in the case of the valves according to the invention, by an appropriate setting of the second pneumatic control device, for a targeted and selective influence to be brought to bear on which suction openings are to be deactivated and which are to be activated. If required, for example, the air supply to covered suction openings can be shut off or throttled by the valves for the purpose of reducing the total suction power acting upon the printing substrate. The second pneumatic control device preferably serves for the format-width-dependent control of the suction air. Each of the valves may advantageously comprise a pneumatically adjustable actuating element. In a preferred embodiment, the valves are controlled by the second pneumatic control device, the actuating element being pneumatically adjustable by control air controlled by the second pneumatic control device.

The invention can be used in web-fed or sheet-fed rotary printing presses operating, for example, by the offset printing method and, furthermore, in presses processing printing substrate.

Other features which are considered as characteristic for the invention are set forth in the appended claims.

Although the invention is illustrated and described herein as embodied in a suction-air control device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
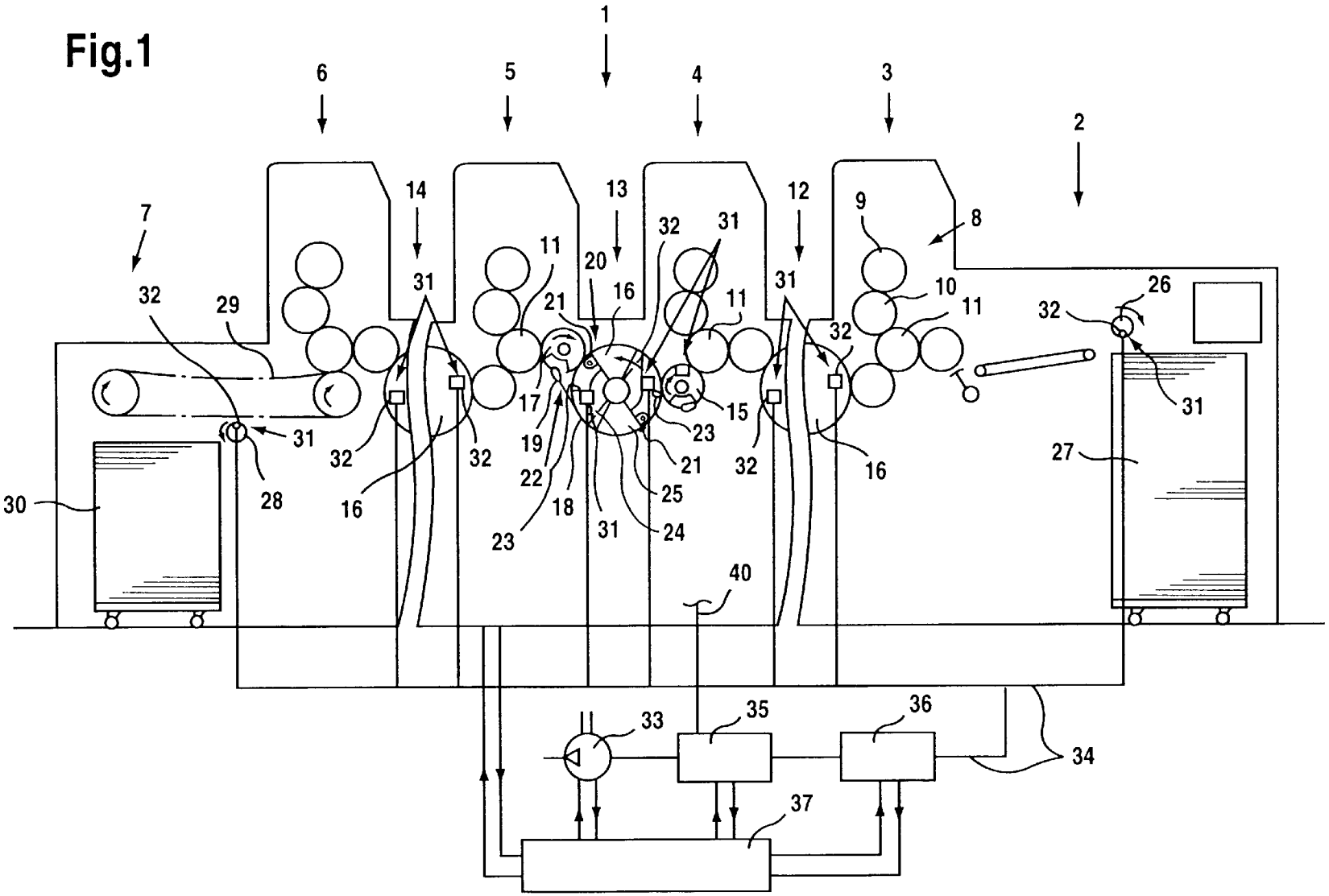
FIG. 1 is a diagrammatic and schematic side elevational view of a printing press having a plurality of devices according to the invention and a storage drum.

Like reference numerals are generally used in all the figures for identical or functionally identical components, even if the components are arranged differently with respect to one another in the figures.

Referring now more specifically to the drawings and, first, particularly to FIG. 1 thereof, there is shown therein a multicolor sheet-fed offset rotary printing press 1 having a plurality of devices 31 for controlling the suction air which can be applied to suction openings of a cylinder of the printing press. The printing press 1 includes a sheet feeder 2, a first printing unit 3, two or more further printing units 4 and 5, a final printing unit 6 and a sheet delivery 7. Each printing unit 3, 4, 5, 6 has a printing device 8, by which the printing ink is transferred onto the printing substrate. The printing devices 8 which are shown include a printing-form cylinder 9, a blanket cylinder 10 and an impression cylinder 11. Arranged between the printing units 3, 4, 5 and 6 are respective sheet-transfer devices 12, 13 and 14, one of which is constructed as a sheet-reversing device 13. The transfer devices 12, 13 and 14, respectively, are formed of three drums 15, 16 and 17. The first drum 15, respectively, transfers the sheet 18 of printing substrate, taken over from the respective printing unit 3, 4 and 5 upline of the respective transfer device 12, 13 and 14, in particular, from the respective impression cylinder 11, to the respective second drum 16, which transfers the sheet 18 to the respective third drum, from which the sheet 18 is transferred to the respective downline printing unit 4, 5 and 6, in particular, to the respective impression cylinder 11. In the exemplary embodiment, a sheet-reversing device 13 with a sheet-transfer drum 15, a sheet-storage drum 16 and a sheet-reversing drum 17 is shown. The reversing device 13 can be selectively operated in two modes. In the first mode (first-form or recto printing mode), the sheet 18 printed on the front side in the printing unit 4 is not reversed or turned and is transferred to the printing unit 5 downline of the reversing device 13 so that the sheet 18 is likewise printed thereat on the front side thereof. In the first-form printing mode, the reversing drum 17 takes over the sheet 18 by pivotable pincers grippers 19 thereof at the leading edge 20 of the sheet, as viewed in the sheet transporting direction. In the second mode (perfector or verso printing mode), the sheet 18 printed on the front side thereof in the printing unit 4 is reversed or turned about the horizontal axis thereof extending perpendicularly to the transporting direction (transverse axis) and is transferred to the downline printing unit 5 so that the sheet 18 is printed thereat on the rear side thereof. In the perfector or verso printing mode, the reversing or turning drum 17 takes over the sheet 18 at the trailing edge 22 thereof. At the same time, the grippers 21 and the suckers 23 release the sheet 18. As the drum 17 continues to rotate, the grippers 19 of the reversing drum 17 pivot about 180° about the axis thereof parallel to the transverse axis of the sheet 18. At the sheet-transfer point between the drums 16 and 17, the pincers opening of the grippers 19 seizing the sheet face forward, as viewed in the direction of rotation of the drum 17. At the sheet-transfer point between the drum 17 and the impression cylinder 11, the pincers opening faces counter to the direction of rotation of the drum 17. In FIG. 1, the grippers 19 are approximately halfway towards reaching this end position. The storage drum 16 may be of a so-called single or multiple size, i.e., single size denoting the conventional size of a printing-form, blanket or impression cylinder. A multiple-size storage drum 16 guides a plurality of sheets 18 simultaneously. In the exemplary embodiment, a double-size storage drum 16, which has two rows of grippers 21 and two rows of suckers 23, is represented. At times, the sheet 18 is held on the lateral surface of the drum 16 simultaneously by the grippers 21 and the suckers 23, the grippers 21 securely clamping and holding the sheet 18 at the leading edge thereof and the suckers 23 holding the sheet 18 in the region close to the trailing edge thereof. The distance of the grippers 21 guiding a sheet 18 from the suckers 23 assigned to these grippers 21 can be set according to the format, so that, according to choice, sheets 18 of different lengths can be securely held in the manner described hereinabove. For this purpose, the suckers 23 are arranged on a double segment 24 which can be turned with respect to a double segment 25 bearing the grippers 21. The drums 16 and 17 are connected to one another, in driving terms, by a non-illustrated train of gearwheels and a clutch integrated in the latter. The frictional clutch transfers the driving motion from a first gearwheel, connected to a first clutch half, to a second gearwheel, connected to a second clutch half. The frictional connection between the clutch elements is releasable, so that the first gearwheel can be turned steplessly or infinitely in relation to the second gearwheel and a stepless or infinite adjustment of the phase position of the storage drum 16 in relation to the reversing drum 17 is possible. This adjustment capability ensures a selective interaction of the grippers 19 with the grippers 21 (first-form or recto printing mode) or with the suckers 23 (perfector or verso printing mode) and a format setting of the grippers 19 and the suckers 23 with respect to one another. The construction of the device 31 according to the invention and of the storage drum 16 enclosing the latter is described in more detail with reference to hereinafter described figures. In FIG. 1, it is further shown that, in addition to the drums 15 and 16 of the transfer devices 12 and 14, as well as, of the reversing device 13, further sheet-fed guiding drums, cylinders or rollers may be provided with the device according to the invention. For example, the feeder 2 may include a suction roller 26 with the device according to the invention, the suction roller 26 assisting in the individual separation of the sheets 18 from the sheet pile 27. The delivery 7 may include, for example, a braking roller 28 with a device according to the invention, the braking roller 28 decreasing the speed of the sheets 18 which are conveyed by a chain gripper system 29 and are to be deposited on a sheet pile 30. The drums 16 and the rollers 26 and 28 have suction openings 23 terminating in the lateral surface thereof, and bear valves 32 connected to the openings. The suction-air supply and the control-air supply are provided by a suction-air source 33, which can be connected to the suction openings 23 via air-directing lines 34 and 40, as well as the first pneumatic control device 35 for the timed feeding of the air and the second pneumatic control device 36 for the format-dependent control of the air. The printing press 1 and, in particular, the suction-air source 33, as well as the pneumatic control devices 35 and 36 are controlled by an electronic control device 37 with a microprocessor in dependence upon one another and upon further operating parameters.

Figure 2:
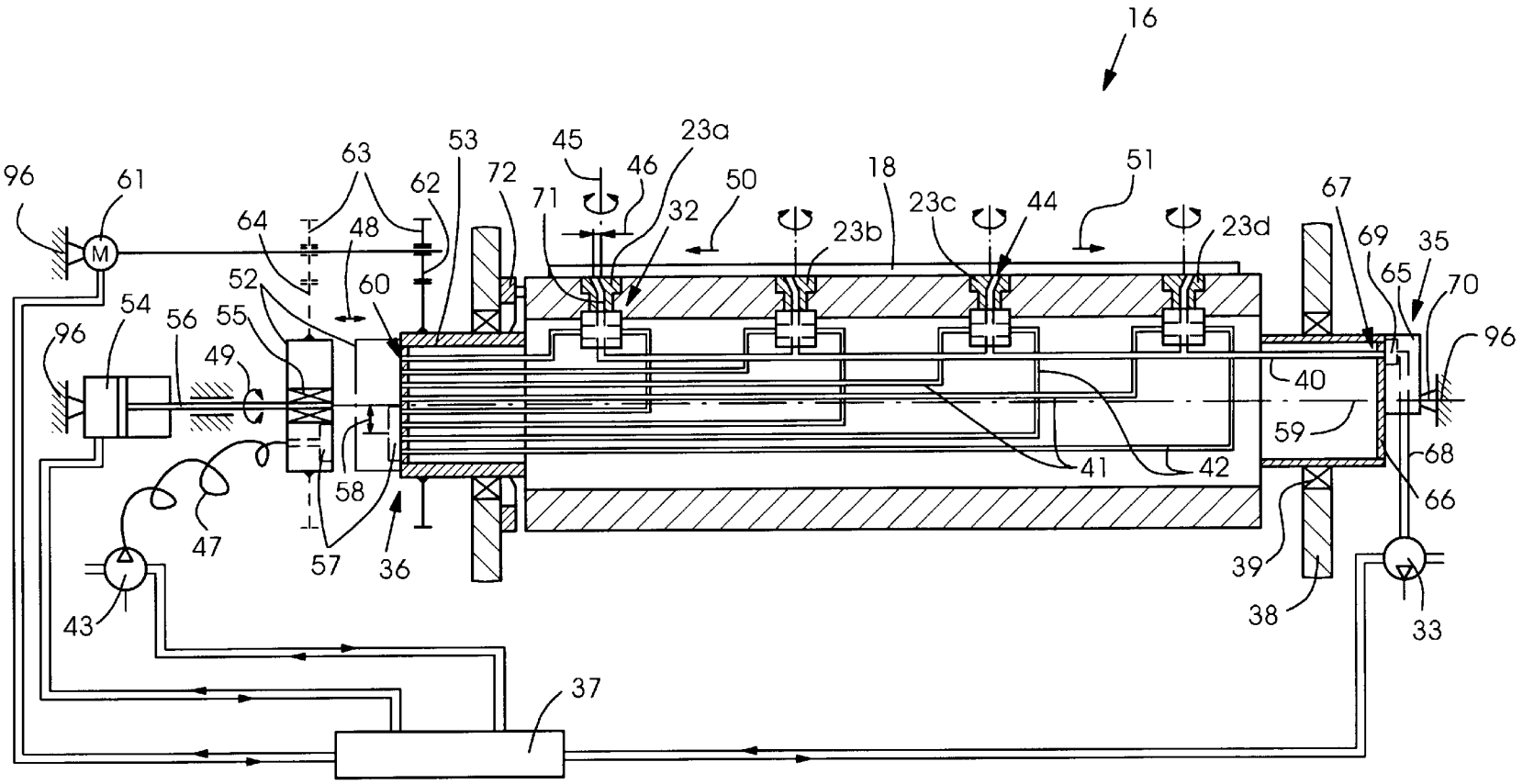
FIG. 2 is a diagrammatic and schematic longitudinal sectional view of the storage drum and of the device according to the invention.

Shown in FIG. 2 is the storage drum 16 with a device for controlling the suction air that has been modified in comparison with the corresponding device of FIG. 1. For reasons of better overall clarity, parts described in connection with FIG. 1 and not serving directly for suction-air control, such as the gripper 21, for example, have not been represented here. Nevertheless, every technically expedient combination of features from FIG. 1 and features from FIG. 2 is within the scope of the invention. This applies similarly to combinations of features mentioned in connection with one of the figures still to follow and features mentioned in connection with another figure. The storage drum 16, mounted in the side walls 38 of the printing press 1 in bearings 39 and carrying the sheet 18, includes a row of adjustable suckers 23*a*, 23*b*, 23*c* and 23*d* with suction openings 44, or orifices or apertures, which can be moved or adjusted in the circumferential direction of the drum and, in particular, in the axial direction of the drum and which can preferably be constructed as the rotary suckers 23*a* to 23*d*. The suckers 23*a* to 23*d* are mounted rotatably in the drum 16 and have a pivotable suction opening 44 which terminates eccentrically offset with respect to the axis of rotation 45 by a distance 46, the openings drawing the sheet 18 smooth from the center of the sheet outwardly, in the circumferential direction of the drum 16 and also in the mutually opposed lateral directions 50 and 51, so that the trailing edge of the sheet lies flat on the suction bar and lateral surface of the drum to ensure that it is taken over in exact register by the grippers 19. To each sucker 23*a* to 23*d*, there is assigned a valve 32 connected to the suction-air line 40, the suction-air supply or evacuation taking place via these valves 32 and the pneumatic control device 35 by the vacuum source 33. The valves 32 can be connected, or coupled, in an air-conducting manner to the compressed-air source 43 via control lines 41 and 42 on the inlet and outlet sides, for example in the form of pipes, channels or preferably hoses, and the second pneumatic control device 36. The compressed-air source 43 is connected to the second pneumatic control device 36 by a flexible line 47, for example a hose, so that the positioning 48 and adjustment 49, thereof, is possible without hindrance. The second pneumatic control device 36 is of bipartite construction and includes an adjustable first control element 52 connected to the drum 16, and engageable with and disengageable from the second control element 53. The positioning 48, or the coupling and uncoupling, of the displaceable first control element 52 is performed by a drive 54, for example a linear drive in the form of the pneumatic cylinder shown. The first control element 52 is rotatably mounted by rotary bearings 55 on the piston rod 56 and has a plurality of clearances, or as shown one recess 57, which is preferably formed as an arcuate slot-shaped groove arranged eccentrically offset a distance 58 with respect to the axis of rotation and drum axis 59 and extending coaxially with this axis 59. The recess 57 can be supplied with compressed air via the line 47 and, with the first control element 52 in the coupled position shown in phantom or by dot-dash lines in FIG. 2, the air can flow into the control lines 41 and 42 from the recess 57 via aperture or orifice openings 60 on the second control element 53, which correspond with the recess 57 and are arranged or combined in an arcuate and coaxial manner with respect to the axis 59. The recess 57 may, according to choice, be brought into line with one or more aperture openings 60 by adjusting the control elements 52 and 53 relative to one another. The adjustment may be performed, for example, by turning the drum 16, and consequently the second control element 53 with respect to the first control element 52, with a transfer of motion from the drive 61 via a gear mechanism, for example via the gearwheel 63 meshing with the gearwheel 62, to the drum 16. In this case, the drive 61 of the printing press can be used advantageously. The adjustment can also be performed by turning the first control element 52 with respect to the second control element 53 by a gear mechanism, for example the gearwheel 63, thereby brought into engagement with the gearwheel 64. A motor acting as a drive 61 can be electronically controlled into the desired rotational positions without any problem. Furthermore, locking mechanisms, for example catches, securing the positions of the control elements 52 and 53 with respect to one another, or a step-by-step motion linkage driven by the drive 61 may be provided. The control of the pneumatically switchable valves 32 takes place in the following steps: firstly, the control elements 52 and 53 are brought into a selected angle-of-rotation position with respect to one another, for example by turning the drum 16 through the intermediary of the drive 61 of the printing press. A different way of moving or adjusting the control elements 52 and 53, for example a linear adjustment of the aperture openings 60 arranged in rows and of a recess 57 extending in a straight line, is likewise possible. Then, the first control element 52 is brought from the first position (represented by solid lines) into the second position (represented by dot-dash lines). In the illustrated position of the control elements 52 and 53 with respect to one another, the control lines 42 on the inlet side, and consequently the actuating elements of the valves 32 of all the suckers 23*a* to 23*d*, are subjected to compressed air, while the control lines 41 on the outlet side are vented, when the printing press 1 and the drum 16 are at a standstill. As a result of being subjected to compressed air, the actuating elements or valve elements of all the valves 32 (not shown in this figure) are, for example, adjusted so that a free flow of the suction air is possible from the suckers 23*a* to 23*d* through the valves 32 into the line 40, so that the maximum-format sheet 18 is securely held over its entire format width. Thereafter, the first control element 52 is released by the second control element 53 and the printing press 1 can be put into operation, retaining the last programmed or set switching states of the valves 32, which are for example constructed with locking-in actuating elements and themselves hold the current switching state. The first pneumatic control device 35 largely corresponds in constructional and functional respects to the second pneumatic control device 36 described hereinabove. Differing from the latter, the third control element 65 and the fourth control element 66 are constantly coupled to one another, as shown, so that in corresponding angle-of-rotation positions of the control elements 65 and 66 with respect to one another, and over a certain angle of rotation, the suction air can flow out of the suction-air line 40 via the aperture opening 67 of the latter into the, for example, single recess 69 or into a plurality of recesses 69, connected via the line 68 to the suction-air source 33, and is consequently fed in a timed manner. The mounting 70 may be adjustable, so that the third control element 65, and consequently the recess 69, can be adjusted in the circumferential direction of the drum 16, and the timed feeding of the suction air can be changed with respect to the phase position (angle-of-rotation position) of the drum 16, i.e. the beginning and end of the suckers 23*a* to 23*d* being subjected to suction air can be varied. Unlike the second pneumatic control device 36, the control elements 66 and 65 of the first pneumatic control device 35 are always in contact with one another. A modification of the first pneumatic control device 35 wherein the circular outlet opening 67 and the arcuate clearance 69 are arranged so that they are exchanged with respect to one another is readily possible.

Figure 3:
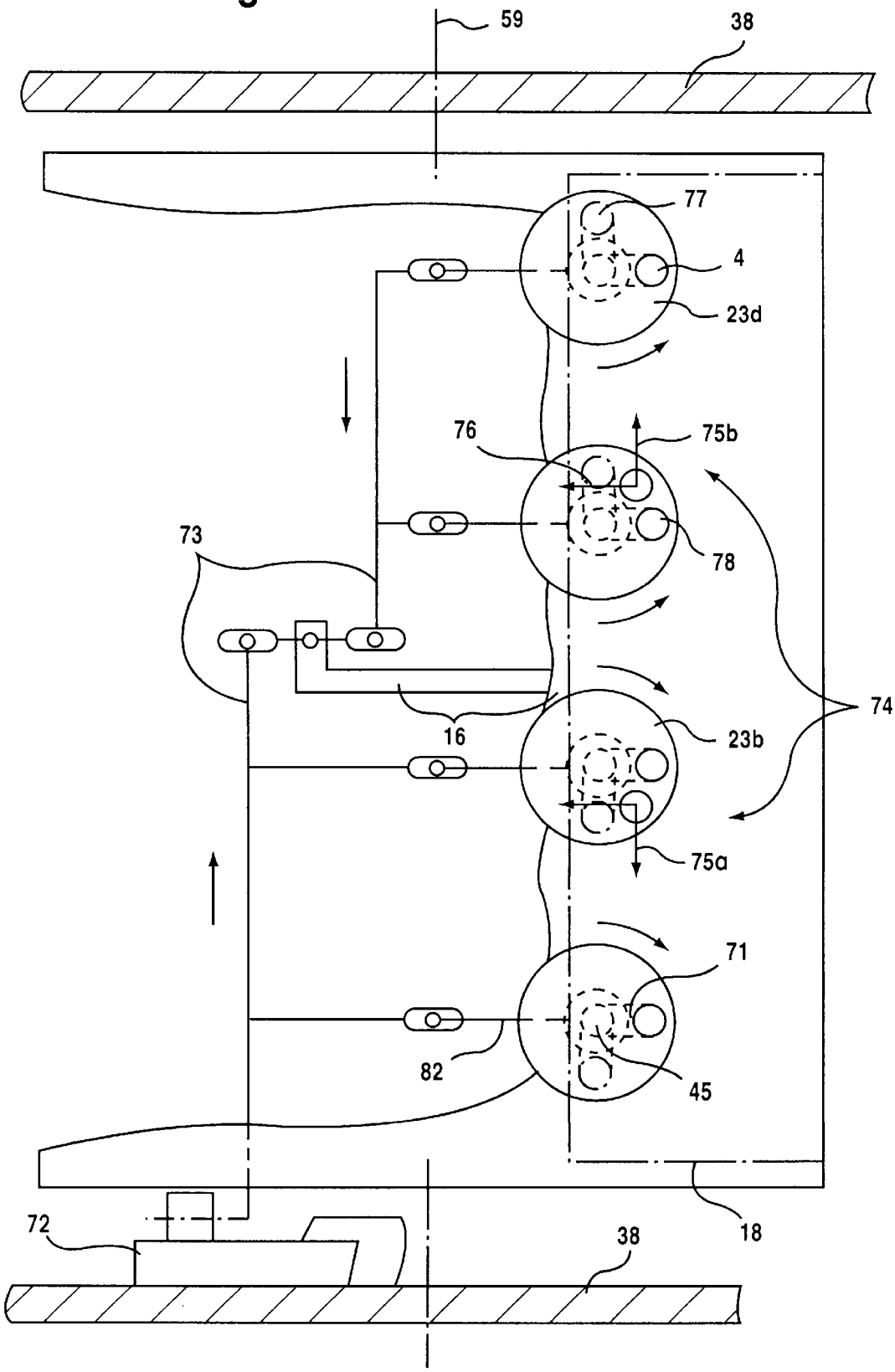
FIG. 3 is an enlarged, more detailed diagrammatic and schematic top plan view of FIG. 2, showing rotary suckers thereof.

In FIG. 3, the principle of the rotary suckers 23*a* to 23*d* is shown in an example for better understanding. Each group of suckers has at least one sucker in each case. By a transmission 72 constructed as a cam transmission, a further transmission 73, constructed as a lever transmission, is driven in dependence upon the rotation of the drum 16 and by the drive of the drum 16. This produces a motion 74 of the outlet openings of the suction channel 71 of the suckers 23*a* to 23*d*, from a starting position 78 which is on a timed basis and is dependent upon the angle-of-rotation position of the drum 16, the motion 74 having a first component of motion 75*a*, 75*b* parallel to the drum axis 59 and a second component of motion 76 in the circumferential direction of the drum 16 and counter to the transporting direction of the sheets. The first component of motion 75*a* of the first group of suckers 23*a*, 23*b* is opposed to the first component of motion 75*b* of the second group of suckers 23*c*, 23*d*, so that the sheet 18 is pulled taut from the center of the sheet in the direction of the outer edges and is held taut. From this holding position 77, 77 shown in phantom or by dot-dash lines in FIG. 3 the suckers 23*a* to 23*d* and their outlets 44, respectively, are returned by the transmission 72, 73 back into the starting position 78, in dependence upon the rotation of the drum 16.

Figure 4:
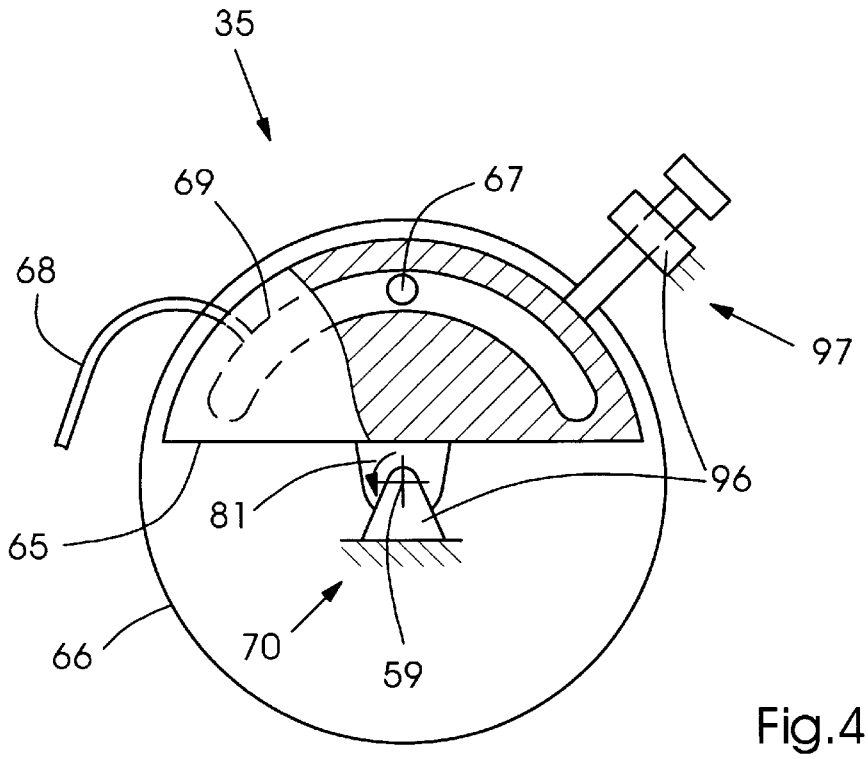
FIG. 4 is a diagrammatic side elevational view, partly broken away and in section of a first pneumatic control device according to the invention.

In FIG. 4, the first pneumatic control device 35 from FIG. 2 is shown in a side view, wherein the previously described details can be seen better and wherein the adjustability 81 of the timed air feeding is shown. The third control element 65 can be pivoted about the axis 59 of the mounting 70, so that the aperture opening 67 interacts with the recess 69 within a range of angles of rotation which can be changed with respect to the phase position of the drum 16, air passing from the aperture opening 67 into the recess 69 in this range of angles of rotation. In this manner, the beginning and end of the suction intake phase is variable with respect to the drum rotation in dependence upon the press speed. The third control element 65 can be held in the set position by a securing device 97, fastened on the frame 96 of the printing press 1 and including, for example, a clamping screw.

Figure 5:
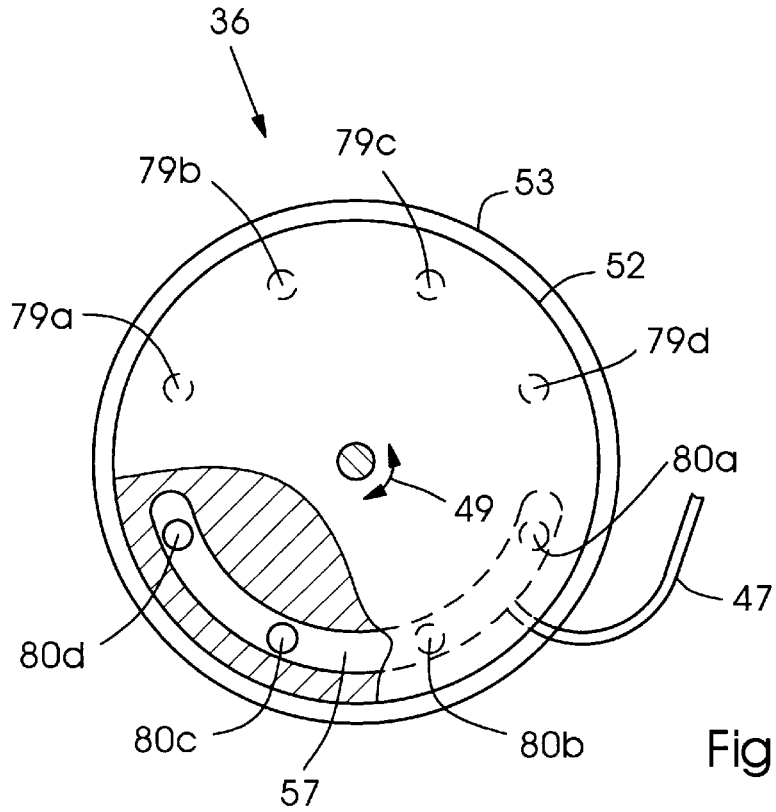
FIG. 5 is a view like that of FIG. 4 of a second pneumatic control device.

In FIG. 5, the second pneumatic control device 36 is shown in a side view. The arrangement of the aperture openings 60, identified without any differentiation in FIG. 2, can be seen from this representation. The aperture openings 60 are formed of the openings 79*a* to 79*d* and 80*a* to 80*d*. The opening 79*a* is the outlet of the control line 41 assigned to the valve 32 of the sucker 23*a*, and the opening 80*a* is the outlet of the control line 42 of the same valve 32. In like manner, the openings 79*b* and 80*b* are connected to the valve 32 of the sucker 23*b*, and the openings 79*c* and 80*c* are assigned to the sucker 23*c*, and the openings 79*d* and 80*d* are assigned to the sucker 23*d*. In the setting shown, all four valves 32 can be supplied simultaneously with the compressed air which is passing from the recess 57 into the openings 80*a* to 80*d* and is fed from the valves 32 via all the control lines 42, and can be pneumatically switched or set, so that, for example, all four valves 32 are switched into the opened switching position, allowing the suction air through. In this setting, the openings 79*a* to 79*d* vent the valves 32. The first control element 52 can be turned counterclockwise through, for example, about 90°, so that the recess 57 then corresponds with the openings 79*c*, 79*d*, 80*a*, 80*b*. In this position, the opened switching position of the valves 32 assigned to the suckers 23*a*, 23*b* is retained and the valves 32 assigned to the suckers 23*c*, 23*d* are closed or throttled. In this position, the openings 79*a*, 79*b*, 80*c*, 80*d* serve for venting. In the case of a modified embodiment, provision may be made for two or more suction openings 23*a* to 23*d* to be assigned to each valve 32. In this way, for example, suction openings 23*a*, 23*d*; 23*b*, 23*c* combined in pairs or groups can be connected simultaneously to the suction air or disconnected therefrom. For example, a staggered shutting off of pairs of suction openings 23*a* to 23*c* of the row of suction openings may be performed, starting at both ends of the row of suction openings and continuing in the direction of the center of the row of suction openings.

Figure 6:
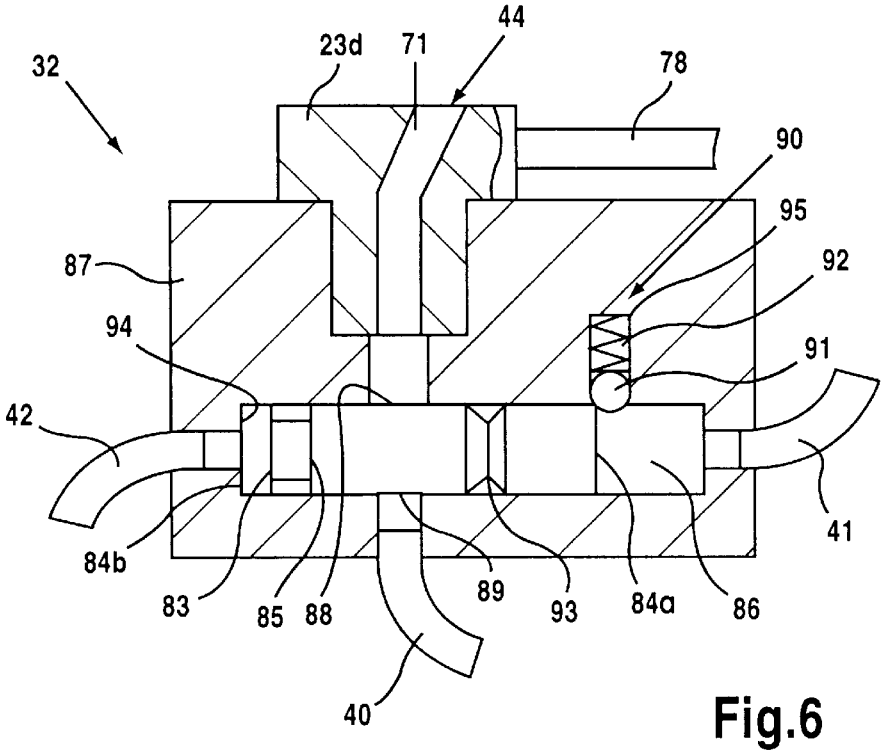
FIG. 6 is a diagrammatic sectional view of an embodiment of a pneumatically controllable valve according to the invention.

Shown in FIG. 6 is a programmable valve 32 which is particularly suitable for the construction of the invention shown in FIG. 2 and itself retains the last-set switching position, independently of the timed-fed or continuously applied suction air holding the sheet 18, until the valves 32 of the valve arrangement are reprogrammed. The actuating element of the valve 32, formed as a displaceable piston with end faces 84*a* and 84*b* which can be acted upon pneumatically, is arranged and guided in a borelike cavity 86 of the housing 87. An annular groove 85 formed in the piston releases the air flow from the inlet opening 88 to the outlet opening 89 in a first position of the actuating element 83 corresponding to the non-illustrated open switching position of the valve 32. Instead of the passage formed as the annular groove 85, a tapering of the actuating element 85 or a bore through the actuating element 85 may also be provided. In the second position shown (closed switching position), the pneumatically adjustable actuating element 83 releases an air flow of a different magnitude than in the first position from the inlet opening 88 to the outlet opening 89 by, for example, as shown, both openings 88, 89 being covered or completely blocked by the circumferential surface of the piston, so that no further significant flow of suction air is possible any longer. The actuating element 83 can be kept in the positions by one or more securing devices 90, for example a catch with a ball 91 or some other locking element and a compression spring 92. The ball 91 can act upon an end face 84*a* of the actuating element 83 so that it blocks the latter, the actuating element 83 bearing with the respectively other end face 84*b* thereof against the housing wall 94. The ball 91 may also, however, engage in recesses 93, for example in the form of grooves, whereby more than two positions of the actuating element 83 can be realized. By subjecting the end faces 84*a*, 84*b* to suction air, or preferably compressed air, via the control lines 41, 42, the actuating element 83 can be displaced in both directions, overcoming the action of the catch, for example, against the action of the spring 92 and the ball 91 thereby pushed back into the bore 95.

Figure 8:
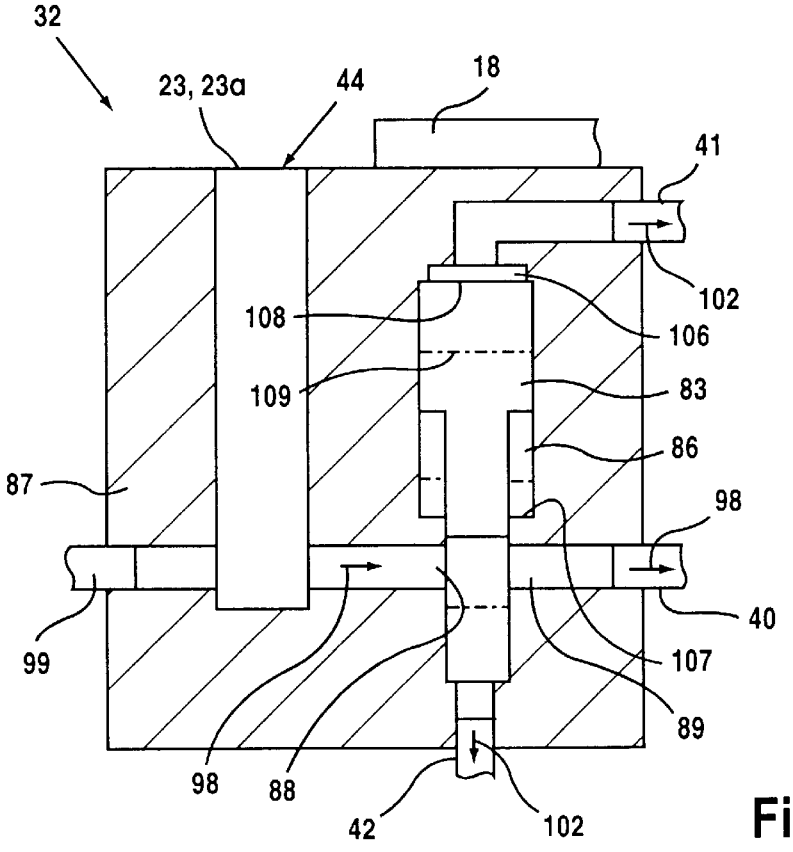
FIG. 8 is a view like that of FIG. 6 of another embodiment of the pneumatically controllable valve forming part of the invention.
Figure 7:
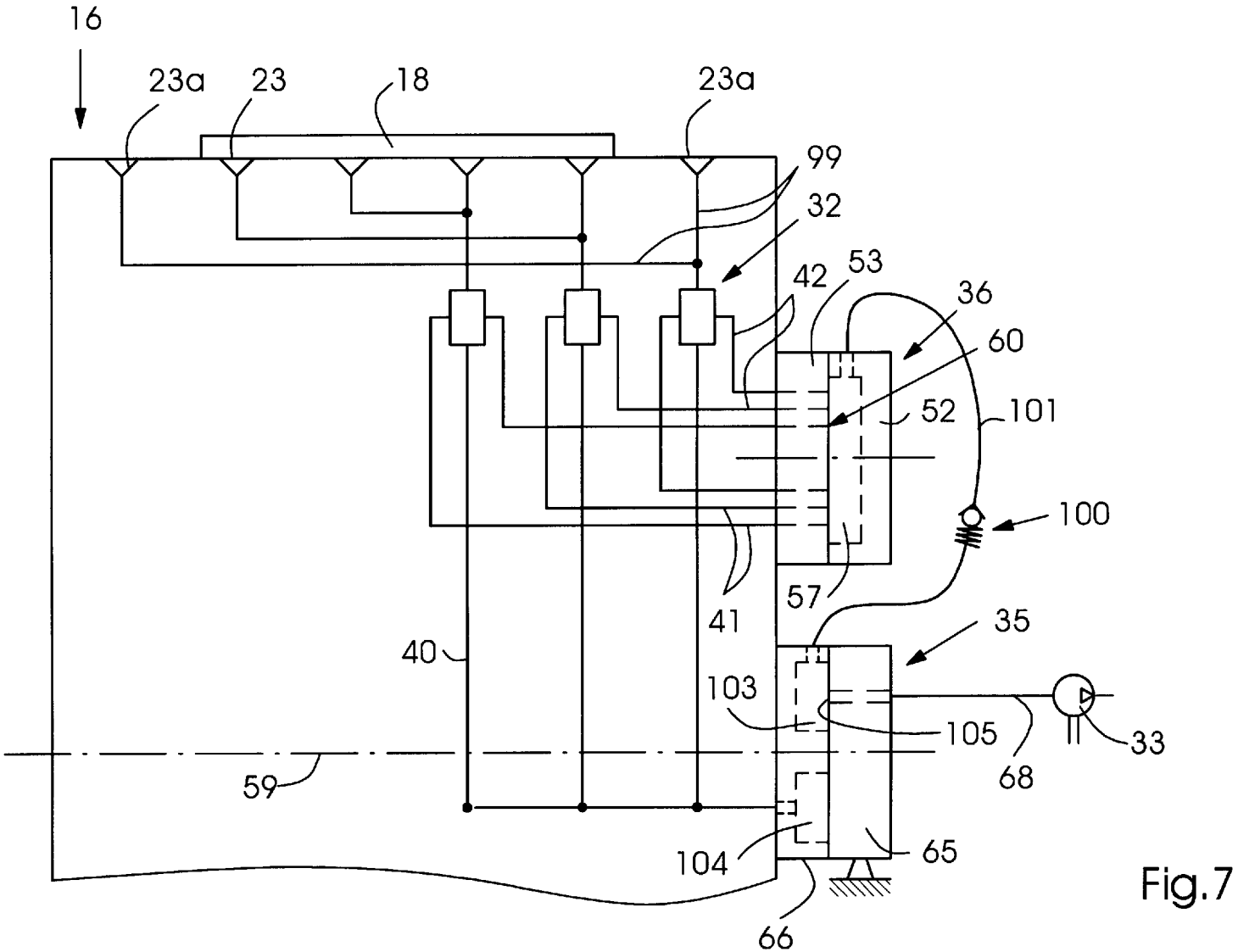
FIG. 7 is a schematic diagram of another embodiment of the device according to the invention.

Shown in FIG. 7 is a further advantageous embodiment of the invention, wherein a plurality of suckers 23, 23*a* are combined in groups and can be supplied jointly with suction air via the system of lines 99. A coupling and uncoupling of the control elements 52, 53, which are constantly connected to one another and are adjustable with respect to one another, is not required in the case of this embodiment. It is favorable here that the suction air 98 (FIG. 8) for holding the sheets 18 from the suction-air source 33, available beforehand in any case on the printing press, is additionally used as control air 102 (FIG. 8) for controlling the valves 32. The air fed on a timed basis by the first pneumatic control device 35 is fed to the valves 32 as timed-fed suction air 98 and, timed at offset intervals with respect to the latter, timed-fed control air 102, i.e. to be precise is discharged from the valves 32, because the external air pressure holds the sheets 18 on the drum 16. The second pneumatic control device 36, connected to the first pneumatic control device 35 via the connection line 101, distributes the control air 102 among the valves 32 in a manner corresponding to the selected setting. In FIG. 7, it is apparent that here the arcuate recesses 103, 104 are assigned to the fourth control element 66, co-rotating with the drum 16, and the outlet opening 105 of the line 68 to the suction-air source 33 is assigned to the third control element 65. The recesses 103, 104, which are not connected to one another or separated from one another, are arranged so that, when the drum 16 rotates, an alternating air flow takes place, with the one effect that the control air 102 is directed from the recess 103 into the opening 105 while, in the interim, the suction air 98 is not applied to the valves, and with the effect at alternating time intervals that the suction air 98 is directed from the recess 104 into the opening 105, while, in the interim, the control-air lines 41, 42 are vented. The nonreturn valve 100, with a spring, arranged in the connection line 101, blocks the airflow from the first pneumatic control device 35 to the second pneumatic control device 36 and releases the airflow in the opposite direction. In this manner, a positional assurance of the actuating elements 83 can be achieved and rattling thereof due to the temporary venting phase of the control lines 41, 42 can be avoided. In the case of the embodiment described hereinabove, no actuating elements 83 constructed as stepped differential pistons are required, but they may be used. The actuating elements 83 may be constructed as simply cylindrical pistons. In the case of a further embodiment, the activation of the valves 32 with the suction air 98 acting as control air 102 and the subjecting of the suction openings 23, 23*a* to the suction air 98 may take place simultaneously, i.e. not at offset timing intervals. In this embodiment, there is no recess 104 and the suction-air lines 40 are connected to the recess 103. Here, however, actuating elements 83 formed as stepped differential pistons, as shown in FIG. 8, are required. This construction ensures a secure fixing of the actuating elements 83 in the opened valve position when suction air 98 is applied to the suction openings 23, 23*a*. The suction air acts upon the small-area end face of the actuating elements 83, while in the interim the control air 102 securely holding the actuating elements 83 acts upon the large-area end face.

Shown in FIG. 8 is a preferred embodiment of the valves 32 for the device according to the invention shown in FIG. 7. In comparison with the programmable valves 32 shown in FIG. 6, these valves 32 hold the current switching state only for a short time, a renewal or restoration of the chosen switching state taking place repeatedly, in dependence upon the rotation of the drum 16, for example, once per drum revolution. If, for example, the suction openings 23*a* not covered by the sheet 18 are to be deactivated, the valve 32 assigned to the suction openings 23*a* is activated by the control line 42 thereof, connected to the clearance 57 in an air-conducting manner corresponding to the setting, outside the suction intake phase, so that the actuating elements 83 are sucked onto the wall 107 and are held on the wall 107 by frictional engagement and/or the nonreturn valve 100 even during the suction intake phase. If appropriate, the actuating elements 83 may be provided with flexible seals, for example plastic rings, the increased friction of which on the guiding surfaces of the cavity 86 produces an additional positional assurance. The actuating elements 83 of the valves 32 of the active suckers 23 are held simultaneously on the opposite wall 106, by the actuating elements 83 being subjected to suction air via the control lines 41 of the valves 32 assigned to the respectively active suckers 23. The recess 57 consequently corresponds simultaneously with the aperture openings 60 of the control lines 41 of the opened valves 32 and the control lines 42 of the closed valves 32. The two mentioned switching positions of the valve 32 are represented in FIG. 8 in phantom or by dot-dash lines as the first position 108, and by solid lines as the second position 109 of the actuating element 83.

We claim:

1. In a suction-air control device for controlling suction air applied to suction openings of a printing-press cylinder receiving printing substrates having various formats, the improvement comprising:

a suction air source;

a control air source;

at least one pneumatically controllable valve disposed on the printing-press cylinder connecting the suction openings of the printing-press cylinder to said suction-air source and having a pneumatically adjustable actuating element connected to said control air source;

a first pneumatic control device for timed or cyclically feeding the suction air from the suction air source;

a second pneumatic control device connected to said control air source, to said at least one pneumatically controllable valve and to said pneumatically adjustable actuating element, for controlling said at least one pneumatically controllable valve, for pneumatically adjusting said actuating element with the control air from said control air source, and for controlling the suction air from the suction air source dependent upon the format of the printing substrate.

2. The device according to claim 1, wherein said second pneumatic control device serves for controlling the suction air in a manner dependent upon the format width of the printing substrate.

3. The device according to claim 1, wherein the control air source is the suction air source such that the suction air from said suction-air source serves as the control air for pneumatically adjusting said actuating element.

4. The device according to claim 1, including a first line and a second line, each of said at least one pneumatically controllable valve having a housing formed with a cavity, said cavity having an inlet opening and an outlet opening, said first line opening into said cavity at said inlet opening, said second line opening into said cavity at said outlet opening, said pneumatically adjustable actuating element being disposed in said cavity and being adjustable into a first position and into a second position for releasing an airflow from said inlet opening to said outlet opening, said airflow of said first position being different in magnitude from said airflow of said second position.

5. The device according to claim 1, including a connection line connecting said second pneumatic control device to said first pneumatic control device in an air-conducting manner, said at least one pneumatically controllable valve being connected to said second pneumatic control device in an air-conducting manner, and said second pneumatic control device being connected to said suction-air source in an air-conducting manner.

6. The device according to claim 5, including a nonreturn valve disposed in said connection line.

7. The device according to claim 5, wherein said second pneumatic control device comprises first and second control elements which are adjustable with respect to one another, said first control element being formed with a recess, control lines opening into said second control element and forming aperture openings, said recess formed in said first control element being assignable to various ones of said aperture openings in dependence upon adjustment of said first and said second control elements.

8. The device according to claim 1, wherein the cylinder is a sheet-transfer drum of a reversing device of the printing press, and the printing press is in a first-form and perfector printing mode.

9. The device according to claim 1, wherein the suction openings are formed as rotary suckers for seizing a trailing edge of a sheet of printing substrate and pulling it taut.

10. The device according to claim 1, in combination with a printing press wherein it is installed.

* * * * *